US006564425B2

(12) United States Patent
Audisio

(10) Patent No.: US 6,564,425 B2
(45) Date of Patent: May 20, 2003

(54) VEHICLE DOOR CHECK DEVICE

(75) Inventor: Vittorio Audisio, Milan (IT)

(73) Assignee: Gammastamp SpA (IT)

( * ) Notice: Subject to any disclaimer, the term of this patent is extended or adjusted under 35 U.S.C. 154(b) by 0 days.

(21) Appl. No.: 09/833,882

(22) Filed: Apr. 12, 2001

(65) Prior Publication Data

US 2001/0029644 A1 Oct. 18, 2001

(30) Foreign Application Priority Data

Apr. 14, 2000 (EP) ..... 00830289

(51) Int. Cl.[7] ..... E05F 5/06
(52) U.S. Cl. ..... 16/86 B; 16/82; 16/86 C
(58) Field of Search ..... 16/82, 86 C, 86 R, 16/86 A, 86 B; 292/DIG. 19, 277, 262, 265; 296/146.12, 146.11

(56) References Cited

U.S. PATENT DOCUMENTS

| | | | | |
|---|---|---|---|---|
| 3,765,053 A | * | 10/1973 | Anweiler | 16/49 |
| 4,788,743 A | * | 12/1988 | Okumura | 16/337 |
| 5,112,091 A | * | 5/1992 | Kluting | 16/86 C |
| 5,152,030 A | * | 10/1992 | Cogo | 16/344 |
| 5,173,991 A | * | 12/1992 | Carswell | 16/325 |
| 5,862,570 A | * | 1/1999 | Lezuch et al. | 16/82 |

FOREIGN PATENT DOCUMENTS

| | | | |
|---|---|---|---|
| DE | 24 06 906 | | 8/1975 |
| DE | 24 49 661 | | 4/1976 |
| DE | 90 01 979 | | 6/1991 |
| DE | 4325550 A1 | * | 10/1994 |
| FR | 2.226.858 | | 11/1974 |
| FR | 2378161 | | 8/1978 |
| GB | 1055874 | | 1/1967 |
| GB | 1290737 | | 9/1972 |
| GB | 2 266 338 | | 10/1993 |
| JP | 210005 | * | 8/1996 |
| JP | 244457 | * | 9/1996 |
| JP | 409235929 A | * | 9/1997 |
| JP | 410331502 A | * | 12/1998 |
| JP | 341527 | * | 12/2001 |

* cited by examiner

*Primary Examiner*—Chuck Y. Mah
(74) *Attorney, Agent, or Firm*—TraskBritt

(57) ABSTRACT

Vehicle door check device comprising:

a longitudinal tie (14) provided on its outer surface with at least one retention seat (16), a holder (12) with a passage (28) through which the tie (14) can slide, a plurality of retention bodies (40) supported by the holder and engaging in the said one or more retention seats so as to define at least one stable retention position, and elastic means (34) acting between the said retention bodies (40) and the said holder (12) so as to push the retention bodies (40) against the tie (14).

The tie (14) has a circular cross section and the retention bodies (40) act along radial directions with respect to the axis of the tie (14).

17 Claims, 3 Drawing Sheets

VEHICLE DOOR CHECK DEVICE

BACKGROUND OF THE INVENTION

The present invention relates to a vehicle door check device of the type comprising:

a longitudinal tie provided on its outer surface with at least one retention seat, a holder with a passage in which the tie can slide, a plurality of retention bodies supported by the holder and engaging in the said one or more retention seats so as to define at least one stable retention position, and elastic means acting between the said retention bodies and the said holder so as to push the retention bodies against the tie.

Retention devices of the type indicated above are known from documents EP-A-0525268, FR-A-1414880, U.S. Pat. No. 2,321,409, DE3515883 and FR1143995.

In the above known solutions, the tie consists of a rectangular-section bar with two major faces on which the retention bodies act as they are pushed elastically against the tie.

One of the problems with the known solutions is that the tie can compensate to only a very limited extent for errors of planarity between the hinge plane of the door and the post. Experience shows that these errors of planarity can be large.

BRIEF SUMMARY OF THE INVENTION

Accordingly, one object of the present invention is to provide a door check device of the type specified above that is simple and reliable and can compensate for even large errors of planarity between the door and the post.

According to the present invention, this object is achieved with a door check device having the characteristics that form the subject of the main claim.

BRIEF DESCRIPTION OF THE SEVERAL VIEWS OF THE DRAWINGS

The invention will now be described in detail with reference to the accompanying drawings, which are given purely by way of nonrestrictive example, in which.

DETAILED DESCRIPTION OF THE INVENTION

Figure 4:
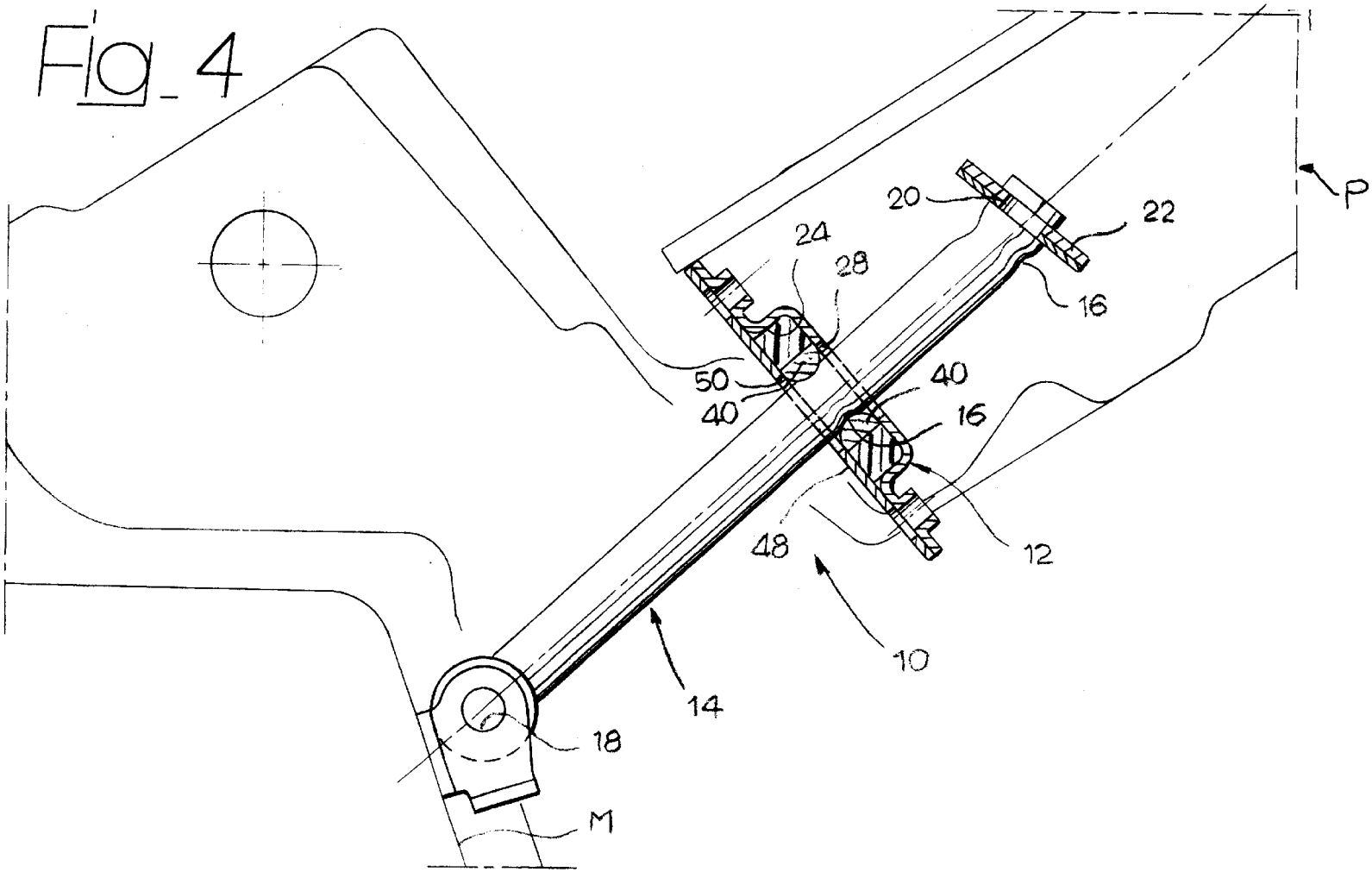
FIG. 4 is a partly sectioned schematic illustrating the door check device according to the invention mounted on a vehicle.

Referring to the figures, the number 10 indicates a vehicle door check device comprising a holder 12 designed to be mounted on a door P of a vehicle, and a longitudinal tie 14 designed to be hinged to a post M of the vehicle about an axis parallel to the hinge axis of the door P. The tie 14 is circular in cross section and has one or more locating seats. In the example illustrated in the figures the tie 14 has two locating seats 16 each in the form of an annular groove formed on the outer surface of the tie. The tie 14 has a hinge hole 18 at one end, and a protuberance 20 at the other to which a stop piece 22 is fixed (FIG. 4). The tie 14 is made of metal and may be provided with a layer of plastic material co-moulded onto its outer surface.

The holder 12 is made of stamped metal and exhibits a chamber 24 of circular shape with a bottom wall 26 in which a passage 28 is formed through which the tie 14 can slide. The holder 12 also has a flange 30 with a pair of holes 32 for fixing the holder 12 to the door P with screws (not shown).

The chamber 24 of the holder 12 houses a plurality of elastic pieces 34, of which there are three in the example illustrated in the figures. The elastic pieces 34 are preferably blocks of elastomeric material in the form of sectors of an annulus of square cross section. Each of the elastic pieces 34 is preferably provided, on its face turned towards the centre of the chamber 24, with a half-cylindrical seat 36 and with two holes 38.

Figure 1:
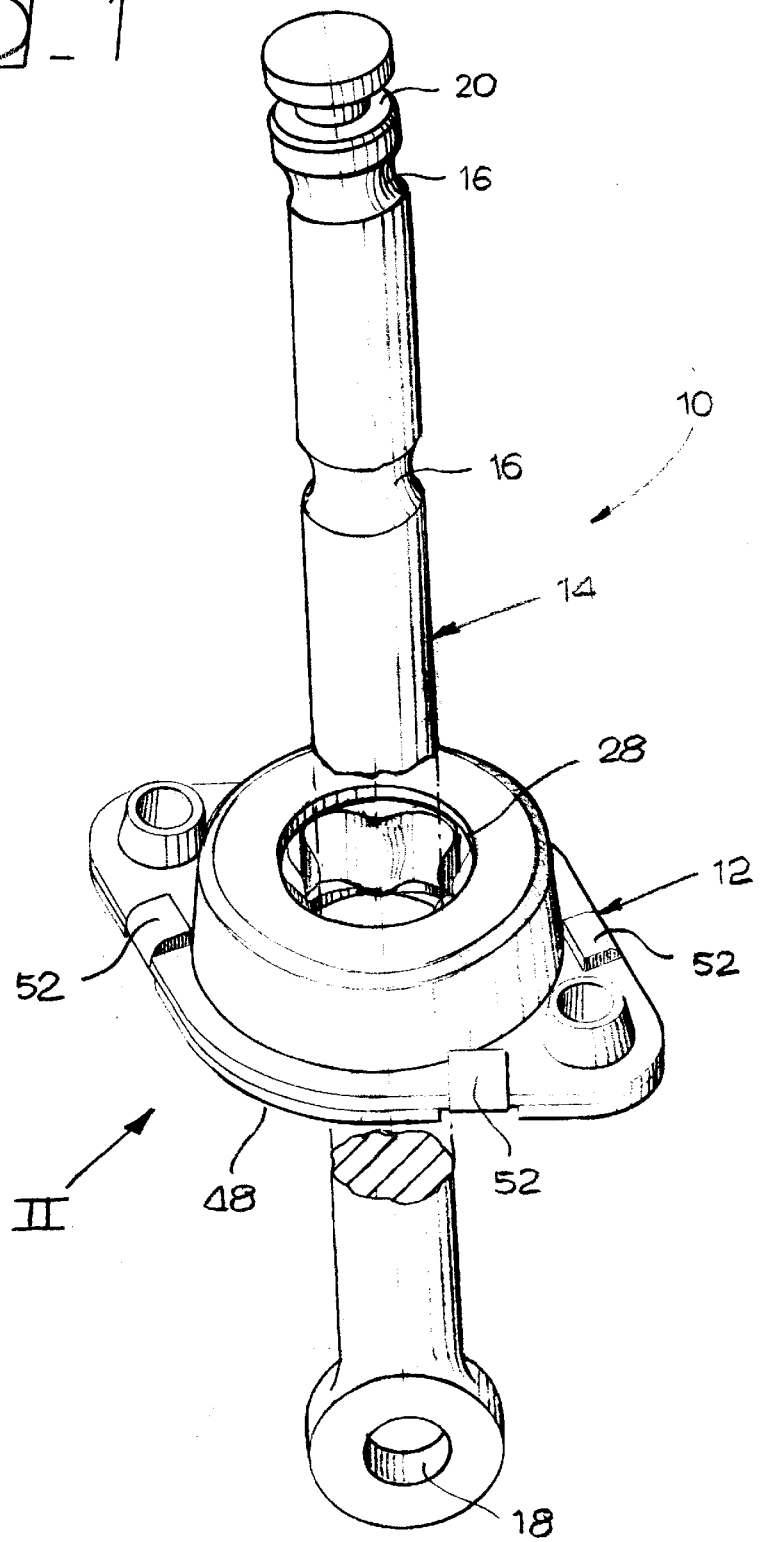
FIG. 1 is a partly sectioned perspective view of a door check device according to the present invention.
Figure 2:
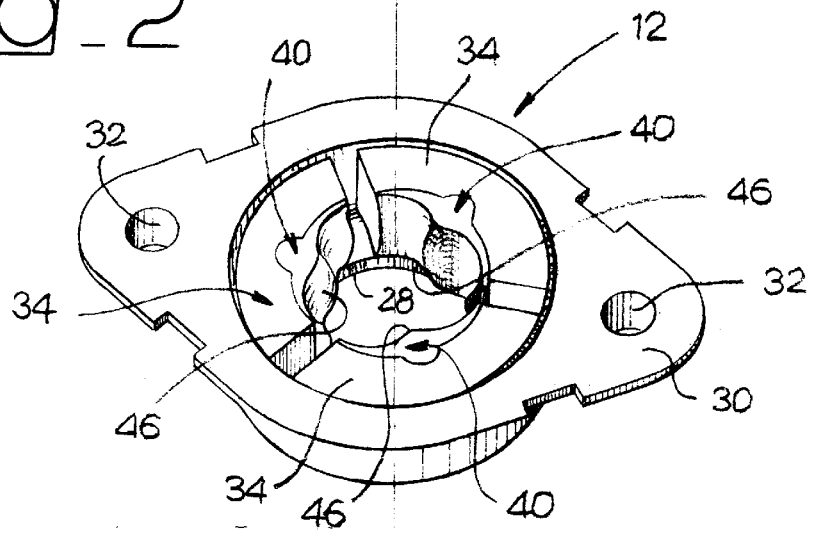
FIG. 2 is a perspective view from a different angle of the holder indicated by arrow II in FIG. 1.
Figure 3:
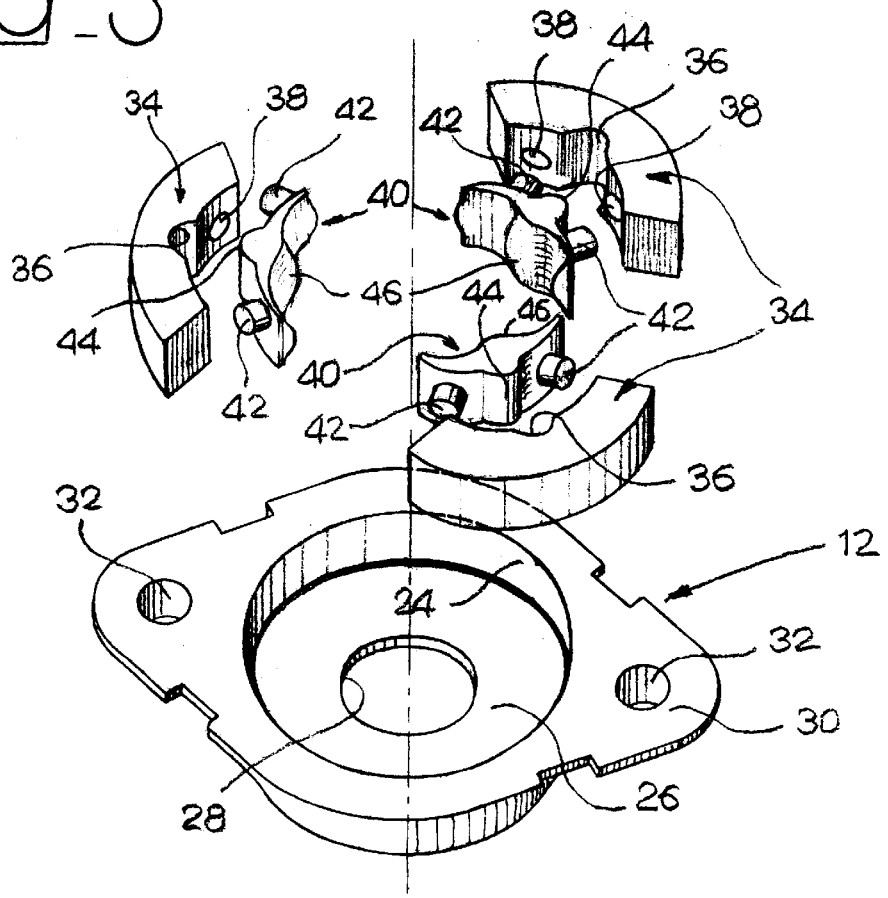
FIG. 3 is an exploded perspective view of the holder of FIG. 2.

The door check device according to the invention also includes a plurality of retention bodies 40 of which there are three in the example illustrated in the figures. Each retention body 40 is of arcuate shape with an outward side resting against the inward face of its particular elastic piece 34. On the outward face of each retention body 40 are a pair of dowel projections 42 that insert into the holes 38 of its particular elastic piece 34. In addition, each retention body 40 possesses a half-cylindrical projection 44 that fits into the half-cylindrical seat 36 of the corresponding elastic piece 34. On the inward face, each retention body 40 has a projection 46 of spherical or cylindrical form designed to engage in the outer surface of the tie 14. The retention bodies 40 may be made of sintered metallic material or rigid plastic material. When the tie 14 is not inserted in the holder 12 the elastic pieces 34 are in a condition of rest. In this condition a circle tangential to the innermost points of the projections 46 of the retention bodies 40 has a diameter less than the smallest diameter of the tie 14. This means that when the tie 14 is inserted into the holder 12, the retention bodies 40 are pushed radially out and radially compress the elastic pieces 34. The retention bodies 40 are therefore pushed elastically radially against the outer surface of the tie 14 by the elastic pieces 34. The mutually interlocking surfaces 44 and 36 of the retention bodies 40 and of the elastic pieces 34, respectively enable the retention bodies 40 to be orientated parallel with the longitudinal axis of the tie 14. The area of contact between each retention body 40 and the outer surface of the tie 14 is essentially point-like. The tie 14 will therefore be free to assume different angles of inclination with respect to the holder 12 without particular constraints or impediments. A closing plate 48 (FIGS. 1 and 4) is fixed to the holder 12 to close the open side of the chamber 24 and prevent the escape of the retention bodies 40 and of the elastic pieces 34. The closing plate 48 contains a hole 50 (FIG. 4) through which the tie 14 can slide. As illustrated in FIG. 1, the closing plate 48 is preferably fixed to the holder 12 by four tabs 52 which are bent over against the holder 12.

Referring to FIG. 4, during the opening and closing of the door P the tie 14 slides in the direction of its own longitudinal axis relative to the holder 12. When one of the locating seats 16 of the tie 14 coincides with the retention bodies 40 inside the holder 12, the projections 46 of the retention bodies 40 drop into the retention seat 16 and produce a retention force on the tie 14. To release the tie 14 from the retention pieces 40 a force greater than a predetermined value must be applied to the door P.

The cylindrical geometry of the tie 14 and of the holder 12 allows the device according to the present invention to compensate automatically for misalignments between the hinge axis of the tie 14 at the post M and the plane to which the holder 12 is fixed. The retention bodies 40 adapt automatically to any variation in the axis of the tie 14 without any appreciable deterioration in its operation.

What is claimed is:

1. Vehicle door check device comprising:

a longitudinal tie with a circular cross section, provided on its outer surface with at least one retention seat, a holder having a chamber with a cylindrical surface and a passage through which the tie can slide;

a plurality of retention bodies supported by the holder and engaging in said at least one retention seat so as to define at least one stable retention position, and elastic means acting so as to push the retention bodies against the tie along radial directions with respect to the axis of the tie;

wherein said elastic means comprises a plurality of blocks of elastic material, each of which is in the shape of a sector of an annulus, with a convex outward side resting against said cylindrical surface of said chamber and a concave inward side;

wherein each of said retention bodies is arcuate with a convex outward side resting against said concave material and an arcuate inward surface having a projection capable of establishing an essentially point-like area of contact with the outer surface of the tie; and wherein said retention bodies and said blocks including mutually-interlocking locating surfaces that enable orientation of the retention bodies along a direction essentially parallel to the axis of the tie.

2. A vehicle door check device comprising:

a longitudinal tie having an outer surface which defines at least one retention seat;

a holder which defines a passage, said longitudinal tie being slidably disposed within said passage, said holder further having an inner sidewall which defines a chamber;

a compressible, elastic structure disposed within said chamber and abutting against said inner sidewall, said elastic structure including a plurality of blocks of elastomeric material, each of said plurality of blocks of elastomeric material being configured in the shape of a sector of an annulus; and a retention body, positioned intermediate said elastic structure and said longitudinal tie, said retention body being in abutment with said elastic structure and being further positioned to engage said at least one retention seat to define at least one stable retention position;

wherein said longitudinal tie is positioned to produce a radial compression of said elastic structure between said inner sidewall and said retention body, wherein said radially compressed, elastic structure produces a reactive force transmitted through said retention body against said longitudinal tie along radial directions with respect to the axis of said longitudinal tie; and wherein said retention body is formed of a plurality of retention body elements, said plurality of retention body elements and said plurality of blocks of elastomeric material including mutually interlocking locating surfaces that enable orientation of said plurality of retention body elements along a direction essentially parallel to the axis of said longitudinal tie.

3. The vehicle door check device of claim 2 wherein said inner sidewall is oriented parallel to a longitudinal axis of said longitudinal tie.

4. The vehicle door check device of claim 2 wherein said radial compression is effected along axes which are perpendicular to a longitudinal axis of said longitudinal tie.

5. The vehicle door check device of claim 2, wherein each one of said plurality of retention body elements is arcuate.

6. The vehicle door check device of claim 5 wherein each said retention body elements defines an inward surface forming a projection for establishing a point area of contact with the outer surface of said tie.

7. A vehicle door check device comprising:

a longitudinal tie having an outer surface which defines at least one retention seat;

a holder which defines a passage, said longitudinal tie being slidably disposed within said passage, said holder further having an inner sidewall which defines a chamber;

a compressible, elastic structure disposed within said chamber and abutting against said inner sidewall, said compressible, elastic structure comprising a plurality of blocks of elastomeric material; and a retention body, positioned intermediate said elastic structure and said longitudinal tie, said retention body being in abutment with said elastic body and being further positioned to engage said at least one retention seat to define at least one stable retention position;

wherein said tie is positioned to produce a radial compression of said elastic structure between said inner sidewall and said retention body and wherein said radially compressed, elastic structure produces a reactive force transmitted through said retention body against said tie along radial directions with respect to the axis of wherein said retention body is formed of a plurality of retention body elements, said plurality of retention body elements and said plurality of blocks of elastomeric material including mutually interlocking locating surfaces that enable orientation of said plurality of retention body elements along a direction essentially parallel to the axis of said tie.

8. The vehicle door check device of claim 7, wherein said tie has a circular cross section.

9. The vehicle door check device of claim 7 wherein each one of said plurality of retention body elements is arcuate.

10. The vehicle door check device of claim 7 wherein said inner sidewall is oriented parallel to a longitudinal axis of said longitudinal tie.

11. The vehicle door check device of claim 7 wherein said radial compression is effected along axes which are perpendicular to a longitudinal axis of said longitudinal tie.

12. The vehicle door check device of claim 7, wherein each of said block of elastic material is in the shape of a sector of an annulus.

13. The vehicle door check device of claim 12 wherein each said block of elastic material includes a convex outward side resting against said inner surface of said chamber.

14. The vehicle door check device of claim 13 wherein said chamber is cylindrical in configuration.

15. The vehicle door check device of claim 13 wherein each block of elastic material includes a concave inward side.

16. The vehicle door check device of claim 15, wherein said retention body is arcuate in configuration, said retention body having a convex outward side resting against said concave inward surface of a respective block of elastic material and an arcuate inward surface having a projection capable of establishing an essentially point-like area of contact with the outer surface of said tie.

17. The vehicle door check device of claim 7 wherein each said block of elastomeric material is configured in the shape of a sector of an annulus.

* * * * *